US005517898A

United States Patent [19]

Kim et al.

[11] Patent Number: 5,517,898

[45] Date of Patent: May 21, 1996

[54] PNEUMATIC CYLINDER UTILIZING CUSHIONING SLEEVES, QUICK EXHAUST VALVES AND QUICK SUPPLY VALVES

[75] Inventors: Hyoung-Eui Kim; Dong-Soo Kim, both of Kyungnam, Rep. of Korea

[73] Assignee: Korea Institute Of Machinery & Materials, Rep. of Korea

[21] Appl. No.: 525,277

[22] Filed: Sep. 8, 1995

[30] Foreign Application Priority Data

Mar. 29, 1995 [KR] Rep. of Korea ..... 95-6898

[51] Int. Cl.[6] ..... F15B 15/22

[52] U.S. Cl. ..... 91/24; 91/407; 92/85 B; 92/143

[58] Field of Search ..... 92/85 B, 143; 91/24, 31, 407, 409, 408

[56] References Cited

U.S. PATENT DOCUMENTS

| | | | |
|---|---|---|---|
| 3,677,141 | 7/1992 | Lagerqvist et al. | 91/407 |
| 4,343,228 | 8/1982 | Wallis | 91/408 |
| 5,125,325 | 6/1992 | Czukkermann | 92/143 |
| 5,413,030 | 5/1995 | Richardson et al. | 92/85 B |

FOREIGN PATENT DOCUMENTS

| | | | |
|---|---|---|---|
| 2075148 | 11/1981 | United Kingdom | 92/85 B |

*Primary Examiner*—Edward K. Look
*Attorney, Agent, or Firm*—Cooper & Dunham

[57] ABSTRACT

A pneumatic cylinder includes a cushioning device having a first cushioning sleeve gradually decreasingly communicating a first cushioning chamber with a first passage formed on a first cap and connected to a first fluid flowing ports as the first cushioning sleeve is gradually inserted into the first passage; a second cushioning sleeve gradually decreasingly communicating a second cushioning chamber with a second passage formed on the second caps and connected to the second fluid flowing ports as the second cushioning sleeve is gradually inserted into the second passage; a first quick fluid exhaust valve which is mounted on the first cap and is selectively opened by pushing force of the piston to communicate the first cushioning chamber with the first passage; a second quick fluid exhaust valve which is mounted on the second cap and is selectively opened by pushing force of the piston to communicate the second cushioning chamber with the second passages; a first quick fluid supply valve which is mounted on the first cap and is selectively opened as pressurized pressure flows into the first chamber to rapidly supply fluid to the second cushioning chamber; and a second quick fluid supply valve which is mounted on the second cap and is selectively opened as pressurized pressure flows into the second chambers to rapidly supply fluid to the first cushioning chamber.

4 Claims, 6 Drawing Sheets

PNEUMATIC CYLINDER UTILIZING CUSHIONING SLEEVES, QUICK EXHAUST VALVES AND QUICK SUPPLY VALVES

BACKGROUND OF THE INVENTION

1. Field of the Invention

The present invention relates to a pneumatic cylinder and, more particularly, to such a pneumatic cylinder which can prevent shocks that could damage its components by reducing cushioning pressure, and can provide speedy working stroke by reducing cushioning time.

2. Description of Related Art

Generally, the pneumatic cylinders convert fluid flowing under pressure to a linear motion to perform mechanical work. One example of a conventional pneumatic cylinder is illustrated in FIGS. 1 and 2. The conventional pneumatic cylinder includes a cylinder body defined by a barrel-like tube 102 and a pair of caps 104 and 106 fixedly disposed on opposite ends of the tube 102, respectively.

The pneumatic cylinder further includes a piston rod 110 slidably extending through the cap 106 into the inside of the tube 102 and a piston 108 fixed at the front end of the rod 110 which is located in the tube 102. Each of the caps 104 and 106 is provided with a plurality of fluid flow ports A and A' through which fluid can come in and leave from the inside of the tube.

The cylinder further includes a cushioning device for preventing shocks caused by reciprocating strokes of the piston 108. The cushioning device has a cushioning plunger 112 formed on the piston 108 and extending in a direction opposite to the rod 110, and a cushioning ring 114 fitted around an extension 113 connecting the piston 108 and the rod 110 with each other.

Further, the inner surface of the cap 104 is provided with a passage 116 which communicates with the port A and into which the plunger 112 can be slidably inserted. The inner surface of the cap 106 is also provided with a passage 118 which communicates with the port A' and into which the cushioning ring 114 can be slidably inserted. Accordingly, fluid within the cushioning chambers R and R' are to be returned to a fluid tank (not shown) through each passage 116 and 118 in accordance with the movement of the piston 108.

When the passage 116(118) is closed by fitting the cushioning plunger 112(the cushioning ring 114) thereinto in accordance with the movement of the piston, the fluid within the cushioning chamber R(R') is not returned to the fluid tank any more through the passage 116(118).

Accordingly, to provide a return passage for residual fluid, the caps 104 and 106 are respectively provided with orifices O and O' on their inner surfaces, which communicate with the ports A and A', respectively.

Further, cushioning valves 120 and 122 are respectively provided on the caps 104 and 106 to restrict the fluid amount passing through the respective orifices O and O' by regulating the opening thereof. This makes the cushioning of the piston which depends on the returning velocity of the fluid be regulated.

In the cushioning device as described above, when the pressurized fluid comes into the cushioning chamber R defined on the left side of the piston 108 through the port and passage A and 116 of the cap 104, the piston 108 within tube 107 forces to the right to perform the linear motion of the piston rod 110.

At this point, before the cushioning ring 114 formed on the extension of the piston 108 is inserted into the passage 118 of the cap 106 to close the passage 118, the piston rapidly moves to the right as the fluid within the cushioning chamber C' defined on the right side of the piston 108 returns to the fluid tank through the port and passage A' and 118.

However, once the cushioning ring 114 closes the passage 118, the piston slowly moves to the right as the residual fluid within the chamber C' returns to the fluid tank through the port A' via the orifice O'. That is, by regulating elastic force and returning velocity of the fluid, cushioning force applied to the piston 108 can be also regulated.

On the other hand, when the pressurized fluid comes into the cushioning chamber R' defined on the right side of the piston 108 through the port A' via the passage 118 of the cap 104, the piston 108 within tube 107 forces again to the left to accomplish the reciprocating motion of the piston rod 110.

At this point, in a similar manner, before the cushioning plunger 112 formed integrally on the left face of the piston 108 is inserted into the passage 116 of the cap 106 to close the passage 116, the piston rapidly moves to the left as the fluid within the cushioning chamber C defined on the left side of the piston 108 returns to the fluid tank through the port A via the passage 116.

However, once the cushioning plunger 112 obstructs the passage 116, the piston 108 slowly moves to the right as the residual fluid within the chamber C' returns to the fluid tank through the passage A via the orifice O. That is, cushioning force which is of elastic force of fluid generated by regulating its return velocity is applied to the piston 108.

FIG. 11 is a graph for comparing a shock power change in response to cushioning operation time and cushioning force of the piston 108 between the cushioning device of the present invention and this conventional cushioning device, wherein the curve line X' shows that the piston 108 receives cushioning force in a section Tss and the maximum shock power Pps is 10 kg f/cm$^2$.

On the one hand, the cushioning force applied to the piston 108 which reciprocates in a state of receiving the shock power as described above can be regulated by the cushioning valve which regulates opening the orifices O and O' for restricting fluid flow amount.

However, since the pneumatic cylinder as described above suddenly restricts the returning velocity of fluid, the shock applied to the cylinder increase such that the cylinder has a short life. Additionally, since the cushioning operation time is getting longer, the stroke time of the cylinder is retarded.

SUMMARY OF THE INVENTION

Accordingly, the objects of the present invention are to provide a pneumatic cylinder which can prevent shocks that could damage its components by reducing cushioning pressure, and can provide speedy working stroke by reducing cushioning time.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the invention provides a pneumatic cylinder comprising: a cylindrical tube; first and second caps respectively fitted on opposite ends of the cylinder tube, the first and second caps being provided with first and second fluid flowing ports, respectively; first and second cushioning regulator valves respectively mounted on the first and second caps to regulate cushioning force; a piston rod slidably extending through one of the caps into the tube; a piston fixed at one end of the piston rod 110 which is located in the cylindrical tube; and a cushioning device for preventing shocks caused by the piston which reciprocates when fluid flows in or out through the fluid flowing pores; wherein the cushioning device comprises a first cushioning sleeve fixed on the piston and extending in a direction opposite to the piston red, the first cushioning sleeve gradually decreasingly communicating a first cushioning chamber with a first passage formed on the first cap and connected to the first fluid flowing ports as the first cushioning sleeve is gradually inserted into the first passage; a second cushioning sleeve fixed around the one end of the piston rod, the second cushion sleeve gradually decreasingly communicating a second cushioning chamber with a second passage formed on the second caps and connected to the second fluid flowing ports as the second cushioning sleeve is gradually inserted into the second passage; a first quick fluid exhaust valve which is mounted on the first cap and is selectively opened by pushing force of the piston to communicate the first cushioning chamber with the first passage; a second quick fluid exhaust valve which is mounted on the second cap and is selectively opened by pushing force of the piston to communicate the second cushioning chamber with the second passages; a first quick fluid supply valve which is mounted on the first cap and is selectively opened as pressurized pressure flows into the first chamber to rapidly supply fluid to the second cushioning chamber; and a second quick fluid supply valve which is mounted on the second cap and is selectively opened as pressurized pressure flows into the second chambers to rapidly supply fluid to the first cushioning chamber.

In another aspect, the present invention provides the pneumatic cylinder, wherein each first and second cushioning sleeve comprises: a plurality of orifices through which inner and outer portions of the cushioning sleeve communicate with each other; a plurality of circumferential grooves formed on an inner circumference of the cushioning sleeve and communicating with the orifices; and a plurality of longitudinal groove formed along an longitudinal direction of the inner circumference of the cushioning sleeve to communicate the circumferential grooves with each other.

In still another aspect, the present invention provides the pneumatic cylinder, wherein the first and second fluid exhaust valves includes a valve body provided with a central hole penetrating its central portion and communicating with the ports, a screw thread formed on an outer circumference of the valve body and screw coupled to a screw thread formed on an inner circumference of a valve hole formed on the first and second caps, a popper valve having a head portion located within the valve hole with a predetermined gap and a stem portion penetrating the central hole with a predetermined gap.

It is to be understood that both the foregoing general description and th following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate one embodiment of the invention and together with the description, serve to explain the principles of the invention.

DETAILED DESCRIPTION OF A PREFERRED EMBODIMENT

Figure 1:
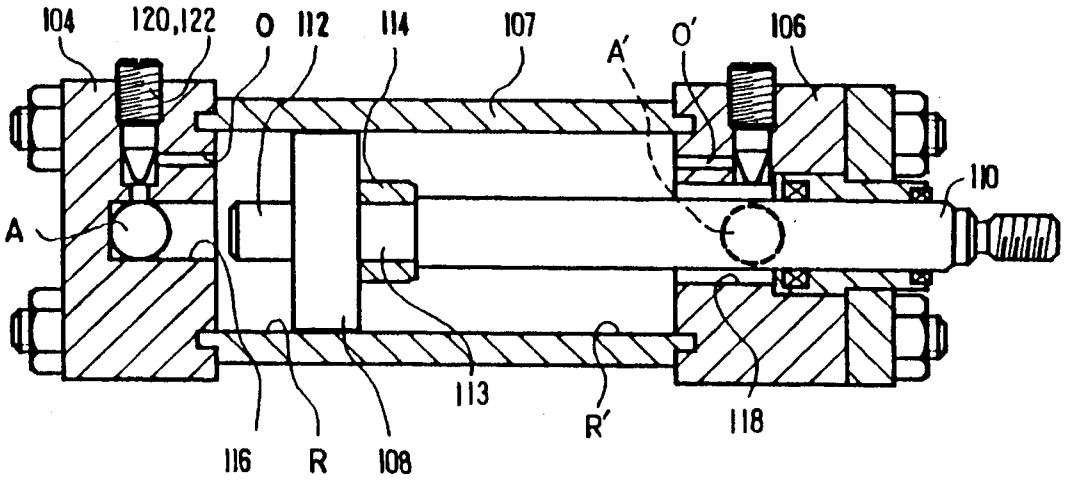
FIG. 1 PRIOR ART
FIG. 1 is a sectional view illustrating a conventional pneumatic cylinder.
Figure 2:
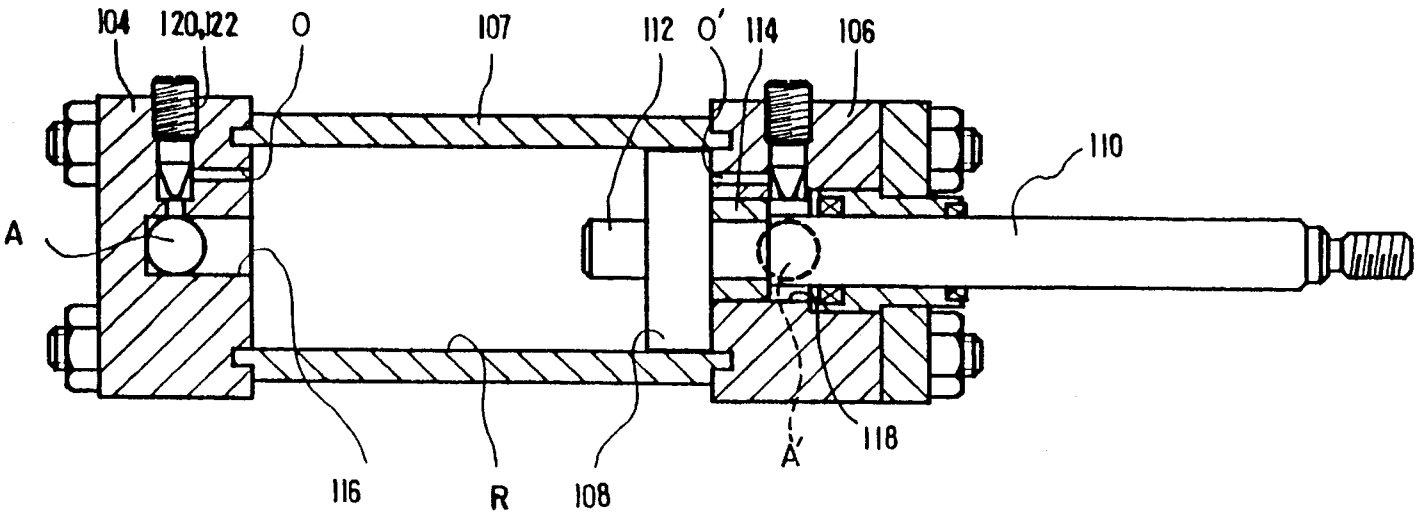
FIG. 2 PRIOR ART
FIG. 2 is a sectional view illustrating an operation state of the pneumatic cylinder depicted in FIG. 1.

Reference will now be made in detail to the present preferred embodiment of the invention, an example of which is illustrated in the accompanying drawings. Wherever possible, the same reference numbers will be used throughout the drawings to refer to the same or like parts.

Certain terminology will be used in the following description for convenience and reference only and will not be limiting. The words "right" and "left" will designate directions in the drawings to which reference is made.

Figure 3:
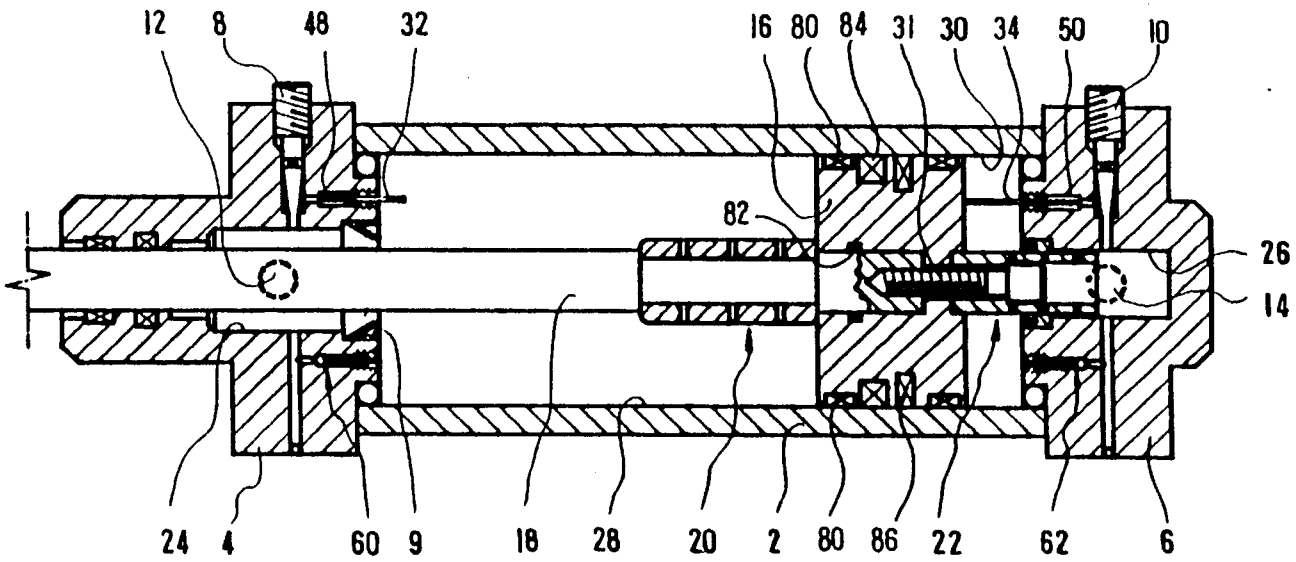
FIG. 3 is a sectional view illustrating a pneumatic cylinder in accordance with a preferred embodiment of the present invention.
Figure 4:
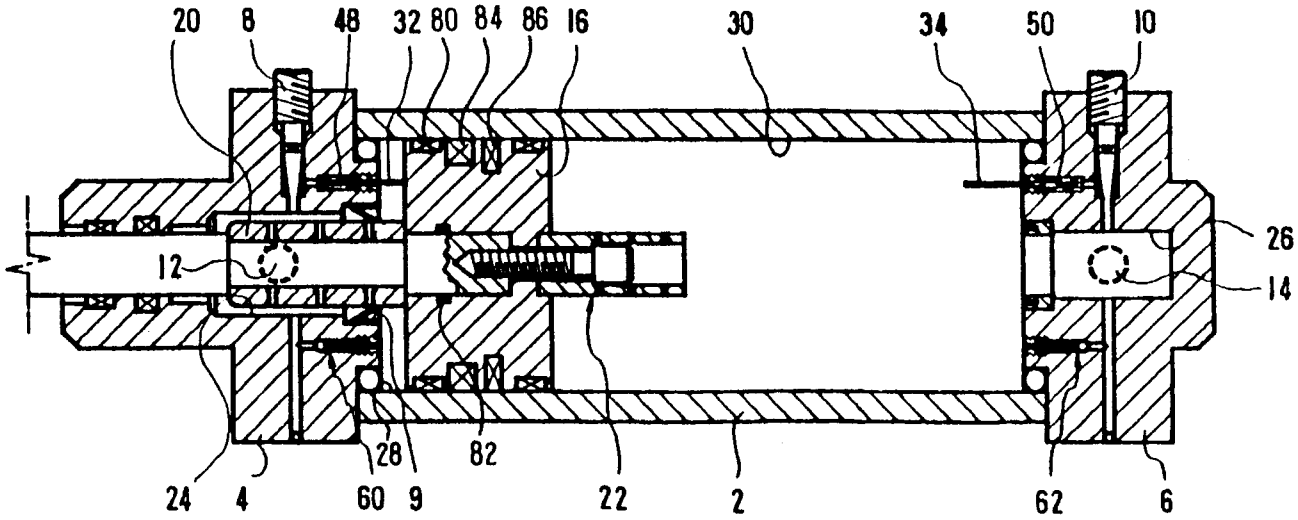
FIG. 4 is a sectional view illustrating an operation state of the pneumatic cylinder depicted in FIG. 3.

Referring to FIGS. 3 and 4, the inventive pneumatic cylinder includes a barrel-like cylindrical tube 2, a pair of caps 4 and 6 which are fixedly disposed on opposite ends of the cylinder tube 2, respectively, and cushion regulator valves 8 and 10 for regulating cushioning force which are mounted on the caps 4 and 6, respectively. The caps 4 and 6 are respectively provided with fluid flow port 12 and 14 and fluid passages 24 and 26 communicating with the ports 12 and 14, respectively.

Further, a piston rod 18 slidably extends through the cap 4 into the inside of the robe 102 and a piston 108 is fixed at one end of the rod 110 which is located in the inside of the tube. Accordingly, the cylinder is to be provided with a first cushioning chamber 28 which is defined by the right face of the cap 4 and the left face of the piston with the inner circumference of the tube 2 and a second cushioning chamber 30 which is .defined by the left face of the cap 6 and the right face of the piston 16 with the inner circumference of the tube 2.

The cylinder further includes a cushioning device for preventing shocks caused by the piston 16 which reciprocates as fluid flows between each cushioning chamber 28 and 30 and a fluid tank(not shown). The cushioning device includes a first cushioning sleeve 20 fixed around one end of the piston rod which is adjacent to the piston 16 and a second cushioning sleeve 22 fixed on the right face of piston 16 by means of a bolt 31 and extending in a direction opposite to the piston rod 18. The cushioning sleeves 20 and 22 have the same structure as each other. such that as the cushioning sleeves 20 and 22 is inserted into respective passages 24 and 26 communicating with the ports 12 and 14, respectively, communicating amount between each cushioning chamber 28 and 30 and each passages 24 and 26 is gradually reduced.

Figure 5:
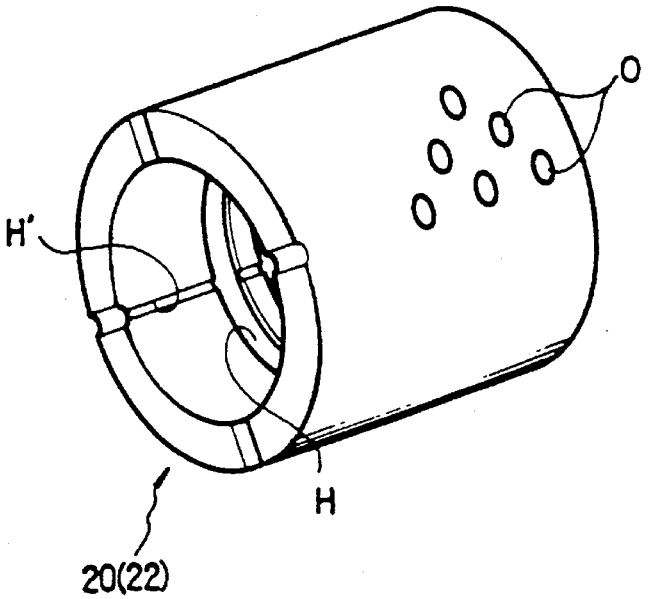
FIG. 5 is a partial perspective view illustrating a cushioning sleeve of a pneumatic cylinder in accordance with a preferred embodiment of the present invention.
Figure 6:
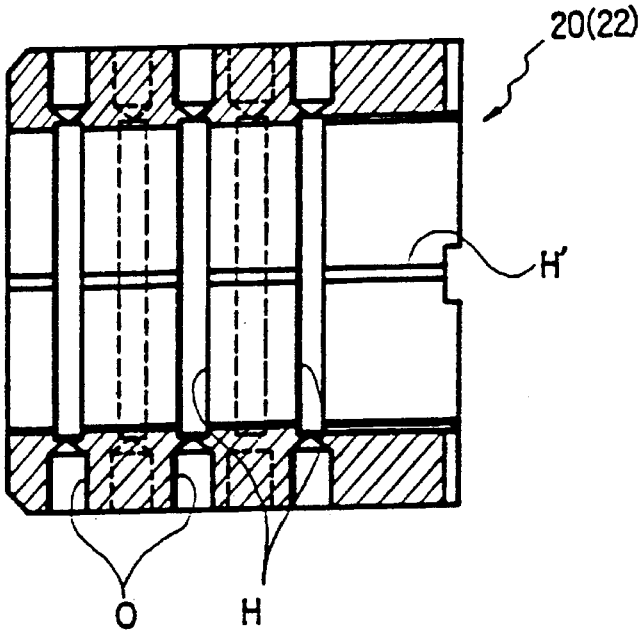
FIG. 6 is a sectional view illustrating the cushioning sleeve depicted in FIG. 5.

As shown in FIGS. 5 and 6, the cushioning sleeve 20(22) is provided with a plurality of orifices O through which inner and outer portion of each cushioning sleeve 20(22) communicates with each other.

Further, the cushioning sleeve 20(22) is provided with a plurality of circumferential grooves H formed on their inner circumference and a plurality of longitudinal groove H' formed along its longitudinal direction and communicating the circumferential grooves H with each other. Accordingly, the passages 24 and 26 are to communicate with each cushioning chamber 28 and 30 through the orifices, the circumferential grooves, and the longitudinal grooves O, H, and H'.

And, a V-shape packing 9 is fixed on each inner end of the passages 24 and 26 to move the cushion sleeves while maintaining a predetermined gap between the cushioning sleeve 20(22) and the passage 24(26)as well as providing a temporary fluid tight seal.

The cushioning device also includes quick fluid exhaust valves 32 and 34, having the same structure as each other, which are mounted respectively on the caps 4 and 6. The quick fluid exhaust valve 32 is opened by being pressed by the left face of the piston 16 when the piston 16 moves leftward, thereby selectively communicating the cushioning chamber 28 and the passage 24 with each other. Further, the quick fluid exhaust valve 34 is opened by being pressed by the right face of the piston when the piston moves rightward, thereby selectively communicating the cushioning chamber 30 and the passage 26 with each other.

Figure 7:
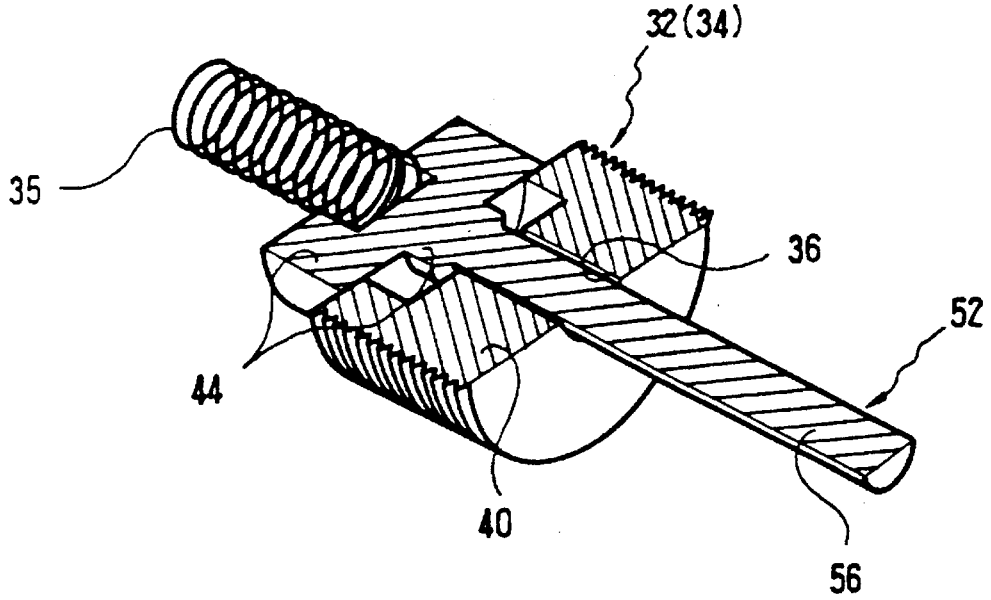
FIG. 7 is a partial section, perspective view illustrating a quick fluid exhaust valve of a pneumatic cylinder in accordance with a preferred embodiment of the present invention.
Figure 8:
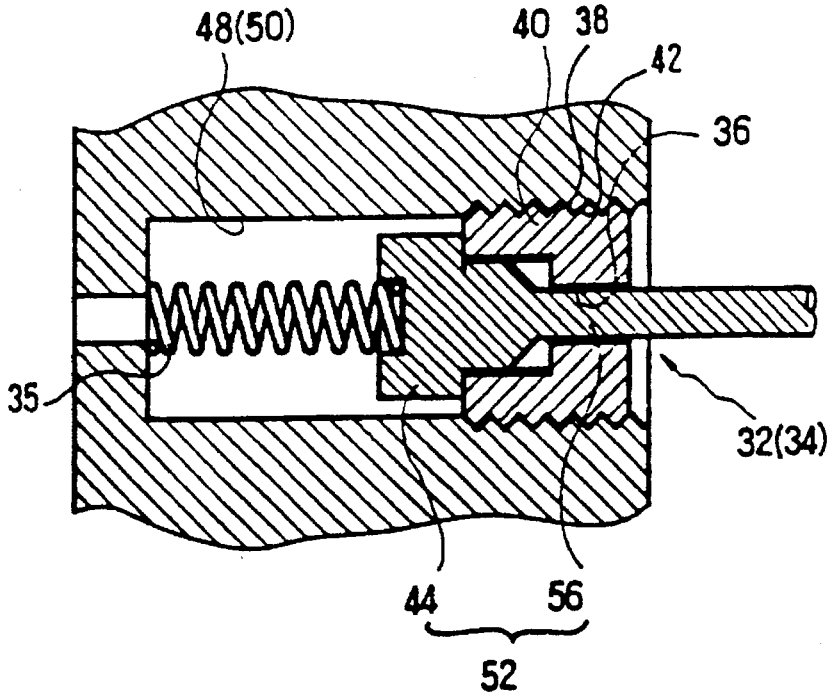
FIG. 8 is a sectional view illustrating the quick fluid exhaust valve depicted in FIG. 8.

As shown in FIGS. 7 and 8, the quick fluid exhaust valve 32(34) includes a valve body 40 provided with a central hole 36 penetrating its central portion and communicating with ports 12 and 14. Further, the valve body is provided with a screw thread 38 formed on its outer circumference which is screw coupled to a screw thread 42 formed on the inner circumference of the valve holes 48 and 50 formed on the caps 4 and 6, respectively.

The quick fluid exhaust valve 32(34) further includes a popper valve 52 having a head portion 44 located within each valve hole 48 and 50 with a predetermined gap and a stem portion 56 penetrating the central hole 36 with a predetermined gap.

Since there is a predetermined gap between the inner circumfernce of the valve hole 48 and the head portion 44 of the popper valve 52, the cushioning chambers 28 and 30 can selectively communicate with each port 12 and 14, respectively, in accordance with open and close of the central hole 36 by the head portion 44.

The head portion 44 of the poppet valve 52 is biased by an elastic member 35 in the valve hole 48 and 50 to maintain the close state of the central hole 36 before the stem portion 56 is pushed by the piston 16.

The cushioning device further includes quick fluid supply valves 60 and 62, having the same structure as each other, so that the fluid can be quickly fed to each cushioning chamber 28 and 30 through each ort 12 and 14 by regulating the opening of each fluid supply valve 60 and 62, thereby enabling the piston 16 to rapidly perform working stroke.

Figure 9:
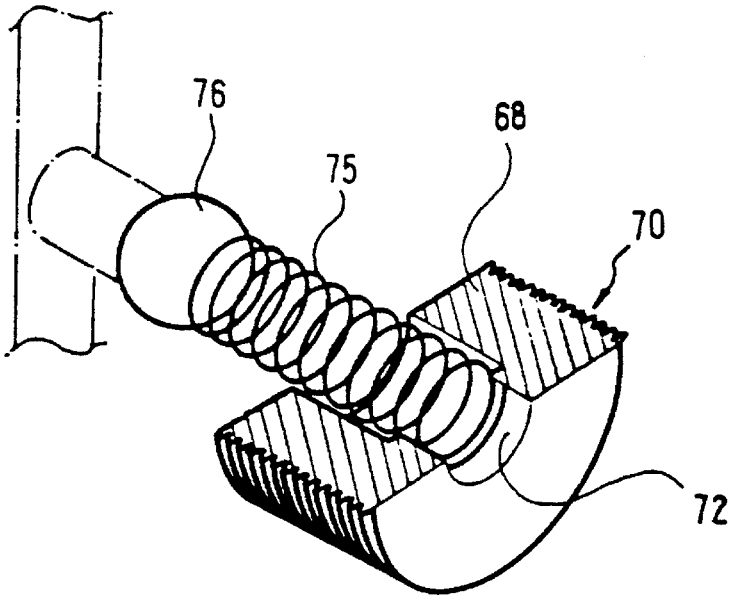
FIG. 9 is a partial section, perspective view illustrating a quick fluid supply valve of a pneumatic cylinder in accordance with a preferred embodiment of the present invention.
Figure 10:
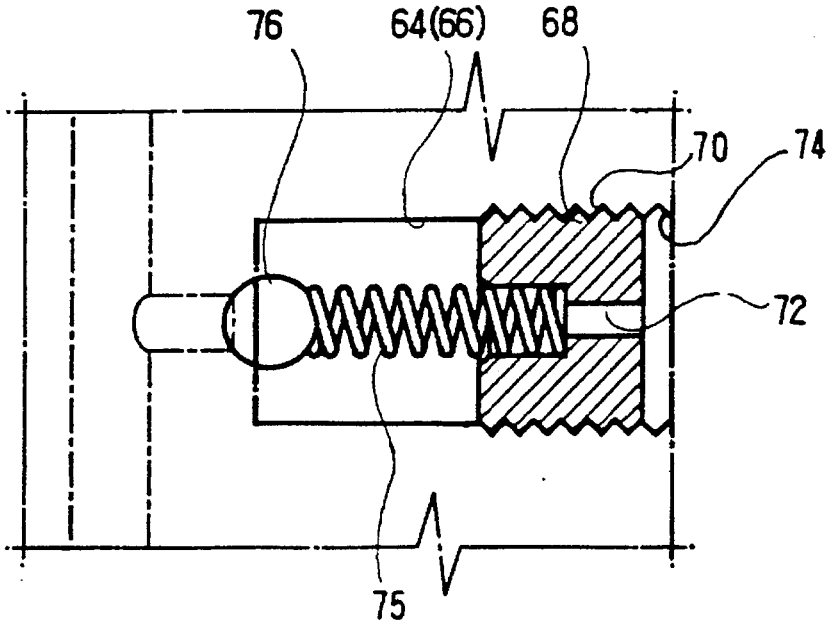
FIG. 10 is a sectional view illustrating the quick fluid supply valve depicted in FIG. 9.

Referring to FIGS. 9 and 10, the quick fluid supply valve 60(62) includes a valve body 68 provided with a fluid communication hole 72 penetrating its central portion and communicating with port 12 and 14. Further, the valve body 68 is provided with a screw thread 70 formed on its outer circumference which is screw coupled to a screw thread 74 formed on the inner circumference of the valve hole 64 formed respectively on the cap 4 and 6.

The valve hole 72 respectively communicates with the cushioning chambers 28 and 30 through the fluid communicating hole 72. Further, a check ball 76 is positioned in the valve hole 64 and is biased by an elastic member 75' against the valve body 68 to selectively open and close the valve hole 64.

The check ball 76 opens the valve hole 64 in accordance with pressurized fluid fed through the ports 12 and 14.

Referring to FIGS. 3 and 4, reference numeral 80 designates a wearing for reducing friction resistance numeral 82 designtes an O-ring for sealing, reference 84 designates a guarder ring for sealing, and numeral 86 designates a magnetic band for supplying with position information necessary for stroke control of the piston 16 responding to a movment of the piston 16.

The operation of the pneumatic cylinder as described above will be described hereinafter in detail.

When pressurized pressure is supplied to the left cushioning chamber 28 through the port 12, the piston with the piston rod 18 is forced to the right by the pressurized fluid and thus fluid within the right cushioning chamber 30 exhausts to the fluid tank (not shown) through the passage 26 via the port 14 formed on the cap 6.

At this point, when the piston moves to a cushioning operation range such that the cushioning sleeve 22 mounted fixedly on the piston 16 is inserted into the passage 26 to close this passage 26, the piston is to receive cushioning force by fluid which is temporarily stagnant within the right cushioning chamber 30.

And, the stagnant fluid within the right chamber 30 is compressed by the piston 16 as the pressurized fluid is continuously supplied to the left chamber 28 such that the cushioning sleeve 22 is further inserted into the port 26. Accordingly, the cushioning chamber 30 and the passage 14 is to be decreasingly gradually communicated with each other through the orifices, circumference grooves, and the longitudinal grooves O, H, and H' all of which are formed on the cushioning sleeve 22 to increasingly gradually apply cushioning force to the piston 18.

Further, when the piston 16 pushes the stem portion 56 of the poppet valve 52 of the quick fluid exhaust valve 34 as cushioning force is gradually decreasingly applied to the piston, the poppet valve 54 overcomes elastic force of the elastic member 35 to move rightward itself such that the head portion 46 opens the central hole 38 of the valve body 42, thereby communicating the cushioning chamber 30 with the fluid passage port formed on the cap 6. As a result, the residual fluid within the chamber 22 returns to the fluid tank (not shown) to rapidly eliminate cushioning force applied to the piston 16.

And then, when pressurized pressure is supplied to the right chamber 30 through the port 14 via the passage 26 to accomplish the reciprocating motion of the piston rod 18, the piston 16 with the piston rod 18 is forced to the left by the pressurized fluid and thus fluid within the left cushioning chamber 28 exhaust to the fluid tank (not shown) through the port 12 via the passage 24 formed on the cap 4.

At this point, when the piston moves to a cushioning operation range such that the cushioning sleeve 20 mounted fixedly around the piston rod 18 is inserted into the passage 24 to close this passage 24, the piston is to receive cushioning force by fluid which is temporally stagnant within the left cushioning chamber 28.

And, the stagnant fluid within the right chamber 30 is compressed by the piston 16 as the pressurized fluid is continuously supplied to the right chamber 30 such that the cushioning sleeve 20 is further inserted into the passage 24. Accordingly, the cushioning chamber 28 and the port 12 is to be decreasingly gradually communicated with each other through the orifices, circumference grooves, and the longitudinal grooves O, H, H' all of which are formed on the cushioning sleeve 20 to increasingly gradually apply cushioning force to the piston 18.

Further, when the piston 16 pushes the stem portion 56 of the poppet valve 52 of the quick fluid exhaust valve 32 as cushioning force is gradually decreasingly applied to the piston, the poppet valve 54 overcomes elastic force of the elastic member 35 to move leftward itself such that the head portion 46 opens the central holes 38 of the valve body 42, thereby communicating the cushioning chamber 28 with the port 12 formed on the cap 6. As a result, the residual fluid within the chamber 28 returns to the fluid tank (not shown) to rapidly eliminate cushioning force applied to the piston 16.

Figure 11:
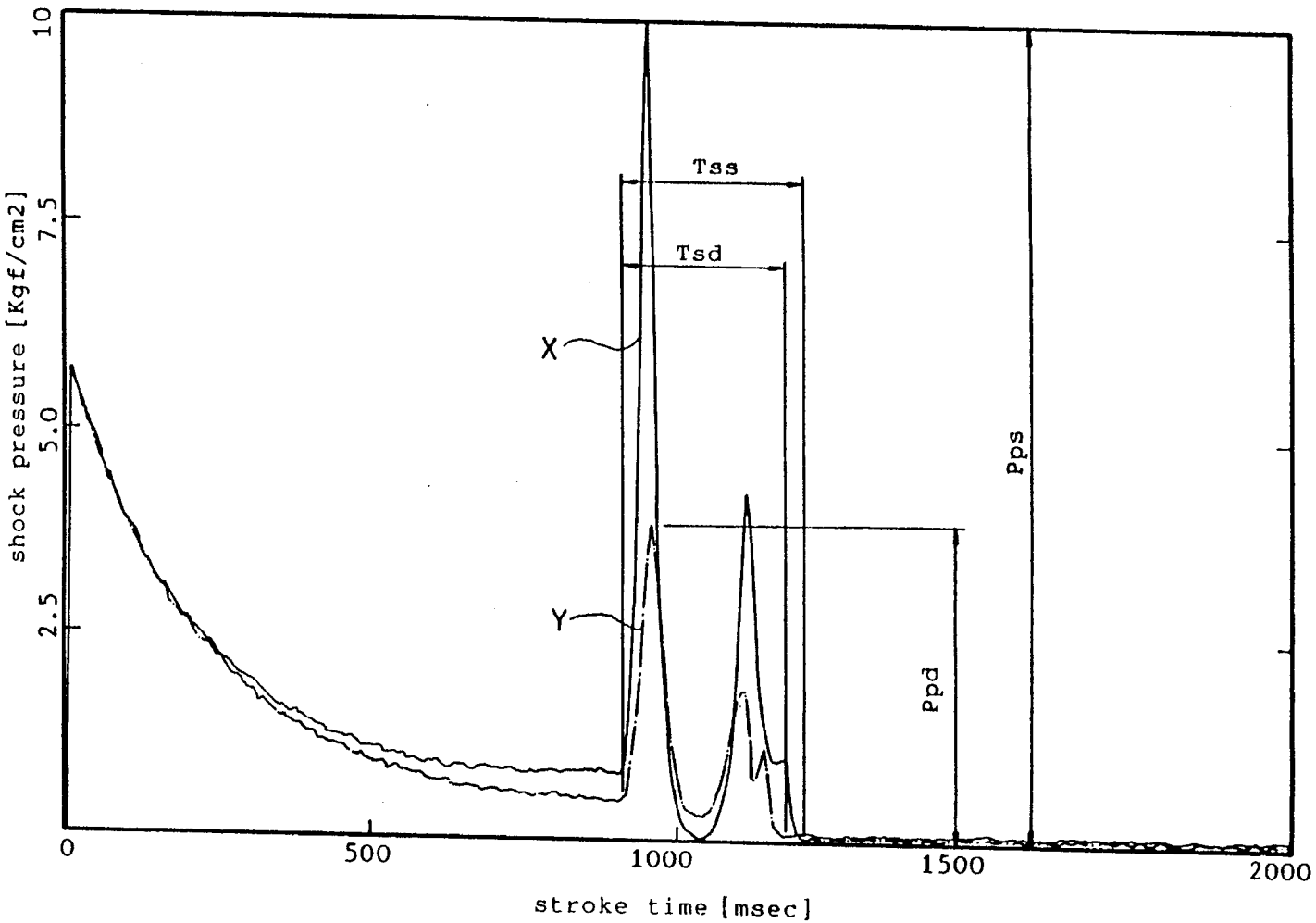
FIG. 11 is a graph for comparing a shock power change in response to cushioning operation time and cushioning force of the piston between the cushioning device of the present invention and the conventional cushioning device.

FIG. 11 is a graph for showing shock pressure characteristic with respect to the stroke time of the piston according to the present invention.

The graph Y shows that the cushioning force is applied to the piston during a stroke time of a section "Tsd" and the maximum shock pressure occurring at this section is below 5 kg f/cm$^2$. This makes the piston rod 18 perform a rapid operation stroke since the time that the cushioning force is applied to the piston is short, as compared with a time of a graph X according to the prior art cylinder. Additionally, this makes the shock pressure generated in the pneumatic cylinder decrease.

Further, likewise the conventional art, the opening of the valve hole can be regulated by the cushioning regulating valves 8 and 10, which makes it possible to control the communication mount of fluid, thereby regulating the magnitude of the cushioning force applied to the piston 16.

It will be apparent to those skilled in the art that various modifications and variations can be made in the pneumatic cylinder of the present invention and in construction of this system without departing from the scope or spirit of the invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A pneumatic cylinder comprising:

a cylindrical tube;

first and second caps respectively fitted on opposite ends of the cylinder tube, said first and second caps being provided with first and second fluid flowing ports, respectively;

first and second cushioning regulator valves respectively mounted on said first and second caps to regulate cushioning force;

a piston rod slidably extending through one of the caps into the tube;

a piston fixed at one end of said piston rod which is located in the cylindrical tube; and a cushioning device for preventing shocks caused by said piston which reciprocates when fluid flows in or out through the fluid flowing ports; wherein said cushioning device comprises a first cushioning sleeve fixed on the piston and extending in a direction opposite to said piston rod, said first cushioning sleeve gradually decreasingly communicating a first cushioning chamber with a first passage formed on the first cap and connected to the first fluid flowing ports as said first cushioning sleeve is gradually inserted into the first passage;

a second cushioning sleeve fixed around the one end of said piston rod, said second cushion sleeve gradually decreasingly communicating a second cushioning chamber with a second passage formed on the second caps and connected to the second fluid flowing ports as said second cushioning sleeve is gradually inserted into the second passage;

a first quick fluid exhaust valve which is mounted on the first cap and is selectively opened by pushing force of said piston to communicate the first cushioning chamber with the first passage;

a second quick fluid exhaust valve which is mounted on the second cap and is selectively opened by pushing force of said piston to communicate the second cushioning chamber with the second passages;

a first quick fluid supply valve which is mounted on the first cap and is selectively opened as pressurized pressure flows into the first chamber to rapidly supply fluid to the second cushioning chamber; and a second quick fluid supply valve which is mounted on the second cap and is selectively opened as pressurized pressure flows into the second chambers to rapidly supply fluid to the first cushioning chamber.

2. The pneumatic cylinder as claimed in claim 1, wherein each first and second cushioning sleeve comprises:

a plurality of orifices through which inner and outer portions of said cushioning sleeve communicate with each other;

a plurality of circumferential grooves formed on an inner circumference of said cushioning sleeve and communicating with the orifices; and a plurality of longitudinal groove formed along an longitudinal direction of the inner circumference of said cushioning sleeve to communicate the circumferential grooves with each other.

3. The pneumatic cylinder as claimed in claim 1, wherein each of said first and second fluid exhaust valves includes a valve body provided with a central hole penetrating its central portion and communicating with the ports, a screw thread formed on an outer circumference of the valve body and screw coupled to a screw thread formed on an inner circumference of a valve hole formed on the first and second caps, a poppet valve having a head portion located within the valve hole with a predetermined gap and a stem portion penetrating the central hole with a predetermined gap, and an elastic member inserted between the valve hole and the head portion of the popper valve for urging the poppet valve in the direction of the cushing chamber.

4. The pneumatic cylinder as claimed in claim 1, wherein each of said first and second quick fluid supply valves includes a valve body provided with a fluid communication hole penetrating its central portion and communicating with passages, a screw thread formed on an outer circumference of the valve body and screw coupled to a screw thread formed on an inner circumference of a valve hole formed on the first and second caps, and a check ball positioned in the valve hole and biased by an elastic member against the valve body to selectively open and close the valve hole.

* * * * *